US006350107B1

(12) United States Patent
Hamutcu

(10) Patent No.: US 6,350,107 B1
(45) Date of Patent: Feb. 26, 2002

(54) RADIAL PISTON PUMP FOR SUPPLYING A HIGH FUEL PRESSURE

(75) Inventor: Kasim-Melih Hamutcu, Stuttgart (DE)

(73) Assignee: Robert Bosch, GmbH, Stuttgart (DE)

( * ) Notice: Subject to any disclaimer, the term of this patent is extended or adjusted under 35 U.S.C. 154(b) by 0 days.

(21) Appl. No.: 09/647,358

(22) PCT Filed: Feb. 9, 1999

(86) PCT No.: PCT/DE99/00344

§ 371 Date: Nov. 17, 2000

§ 102(e) Date: Nov. 17, 2000

(87) PCT Pub. No.: WO99/50555

PCT Pub. Date: Oct. 7, 1999

(30) Foreign Application Priority Data

Apr. 1, 1998 (DE) ..... 198 14 506

(51) Int. Cl.[7] ..... F04B 1/04; F04B 19/00; F01B 1/00

(52) U.S. Cl. ..... 417/273; 417/470; 417/471; 92/72

(58) Field of Search ..... 417/273, 470, 417/471; 92/72

(56) References Cited

U.S. PATENT DOCUMENTS 3,628,425 A * 12/1971 Morita ..... 91/491
4,075,932 A * 2/1978 Eickmann ..... 91/488
5,277,553 A * 1/1994 Stolpp ..... 417/273

FOREIGN PATENT DOCUMENTS

DE 19725564 * 6/1997 ..... F04B/1/04
GB 1436752 * 5/1976 ..... F04B/1/04

* cited by examiner

*Primary Examiner*—Charles G. Freay
*Assistant Examiner*—Timothy P. Solak
(74) *Attorney, Agent, or Firm*—Ronald E. Greigg

(57) ABSTRACT

A radial piston pump for supplying high fuel pressure in fuel injection systems of internal combustion engines that include a common rail. Pistons, which are disposed in a respective cylinder chamber, each of the pistons have a plate connected to one end. A center of each of the plates is embodied so that the stresses that occur in this location during operation are reduced. Reducing the stresses in each plate center advantageously extends the service life of each of the plates. A perfect function of the plate is thus assured, even at peak pressures of up to 2000 bar.

19 Claims, 2 Drawing Sheets

RADIAL PISTON PUMP FOR SUPPLYING A HIGH FUEL PRESSURE

BACKGROUND OF THE INVENTION

The invention relates to a radial piston pump for supplying a high fuel pressure in fuel injection systems of internal combustion engines, particularly in a common rail injection system, with a drive shaft supported in a pump housing. The drive shaft is embodied eccentrically or has cam-like projections in the circumference direction, and preferably includes a number of pistons with, each piston in its own cylinder chamber arranged radially with regard to the drive shaft. Plates are respectively attached to the ends of these cylinders oriented toward the drive shaft, wherein the pistons can reciprocate in the radial direction in their respective cylinder chambers by means of the rotation of the drive shaft.

In a radial piston pump of this kind, which is supported on the inside, the plates attached to the respective end of each of the pistons contact the drive shaft. The pistons are set into a reciprocal motion one after the other due to the eccentricity of the drive shaft or the cam-like projections on the drive shaft. As a result, depending on the fuel quantities aspirated into the cylinder chambers, relatively high forces are exerted by the rotating drive shaft onto the pistons in order to exert pressure on the fuel. During the intake of fuel, the pistons are pressed with the plate against the drive shaft, as a rule by means of a spring.

In the scope of the current invention, it has turned out that the conventionally used plates frequently experience damage during operation, particularly in the center. These abrasion phenomena can lead to breakage of the plate and are therefore undesirable. With a damaged plate, the function of the radial piston is no longer assured. A replacement of a damaged plate is time-consuming because the radial piston pump must be dismantled and the drive shaft must be removed in order to gain access to the damaged plate.

OBJECT OF THE INVENTION

An object of the invention, therefore, is to produce a radial piston pump which overcomes the disadvantages mentioned above. In particular, damage to the plate should be prevented. During operation, the plate should function in an abrasion-free manner, even at high pressures. This should also guarantee a perfect operation of the radial piston pump even with a partial filling of the cylinder chambers. The radial piston pump according to the invention should be able to withstand a pump pressure of up to 2000 bar.

BRIEF SUMMARY OF THE INVENTION

In a radial piston pump for supplying high fuel pressure in fuel injection systems of internal combustion engines, particularly in a common rail injection system, with a drive shaft supported in a pump housing, the drive shaft is embodied eccentrically or has cam-like projections in the circumference direction. The pump includes a number of pistons, each in their own cylinder chamber, arranged radially with regard to the drive shaft. Plates are respectively attached to the ends of these cylinders oriented toward the drive shaft, wherein the pistons can reciprocate in the radial direction in their respective cylinder chambers by means of the rotation of the drive shaft. The object is attained by virtue of the fact that the plate is embodied in the center so that the stresses occurring at this location during operation can be reduced. In tests using the finite element method, it has turned out that the greatest stresses during operation occur in the center of the plate. The damage to the plate during operation is a result of these stresses. Reducing the stresses in the center of the plate advantageously extends the service life of the plate. A perfect function of the plate is thus assured, even at peak pressures of up to 2000 bar.

One particular embodiment of the invention is characterized in that the plate has a smaller thickness in the center than in the outer regions. As a result, the stresses are reduced in the center of the plate. The flux of force is diverted to the outer regions. This produces a diversion of force to those areas that experience less stress. This relieves the critical region in the center of the plate. The concrete embodiment of the plate is particularly significant. In this connection, different embodiments are possible which accomplish all of the shared fundamental concepts of the current invention. Depending on the plate type, the plate can have a central recess for receiving one end of one of the pistons. In such a case, the embodiment of the plate center according to the invention is disposed inside the recess.

Another particular embodiment of the invention is characterized in that in the center, on the side oriented away from the drive shaft, the plate has a recess in the form of a cone, whose tip is directed toward the inside of the plate. This conical embodiment of the plate in the center can be produced, for example, by means of a turning machine. This has the advantage that conventional plates can easily be embodied according to the current invention. Moreover, it has turned out that the conical form is particularly well suited to optimizing the stress distribution in the plate.

Another particular embodiment of the invention is characterized in that in the center, on the side oriented toward the drive shaft, the plate has a recess in the form of a cone, whose tip is directed toward the inside of the plate. The plate can be embodied as conical on either its top or bottom side. The choice of the top or bottom side depends on the forces acting on the plate. In the scope of the current invention, it has turned out that it is advantageous to embody the cone in particular on the side in which the greatest forces occur. As a rule, this is the side on which the drive shaft is disposed.

Another particular embodiment of the invention is characterized in that on the side oriented away from the drive shaft and on the side oriented toward the drive shaft, the plate has respective recesses in the center, each in the form of a cone, wherein the tips of the two cones are directed toward each other. According to the invention, the best results are achieved if both the top and bottom side of the plate are embodied as conical in the center. As a result, an optimal stress distribution is produced during operation. The abrasion resistance of a plate embodied in this fashion is advantageously increased.

Another particular embodiment of the invention is characterized in that the height of the cone on the side oriented away from the drive shaft is approximately 1/10 the height of the cone on the side oriented toward the drive shaft. This is advantageous because the greatest forces occur on the side oriented toward the drive shaft. This is particularly the case when the cylinder chambers are not completely filled. The precise dimensions of the plate depend among other things on the pump pressure and the amount of load change per unit of time.

Another particular embodiment of the invention is characterized in that the plate is round. In principle, it is also possible to use rectangular plates, but the round form is preferable due to the more favorable introduction of force in connection with the drive shaft.

Another particular embodiment of the invention is characterized in that the plate has a round recess in the center. The round recess in the center of the plate serves to receive the end of one of the pistons oriented toward the drive shaft. When the end of the piston is received in the recess, the plate essentially can no longer move in relation to the drive shaft.

Another particular embodiment of the invention is characterized in that the plate has a collar. The collar constitutes a stop for a cage which is fastened to the piston and serves to hold the plate against the piston.

Another particular embodiment of the invention is characterized in that a ring is disposed between the drive shaft and the plate. The ring serves to transmit forces from the eccentrically embodied drive shaft onto the plate. Advantageously, the ring is supported so that the ring can slide on the drive shaft. The ring can be embodied as either cylindrical or polygonal.

The current invention generally has the advantage that the fundamental concepts of the current invention can be used in a simple manner on existing radial piston pumps. Moreover, the component strength is increased, particularly in the event of a zero delivery in the intake stroke.

Additional advantages, features, and details of the invention ensue from the claims and the description below in which an exemplary embodiment is described in detail in conjunction with the drawings. The features mentioned in the claims and in the description can be essential to the invention by themselves or in arbitrary combinations. One way to embody the invention claimed will be explained in detail below in conjunction with the drawings.

DETAILED DESCRIPTION OF THE INVENTION

Figure 1:
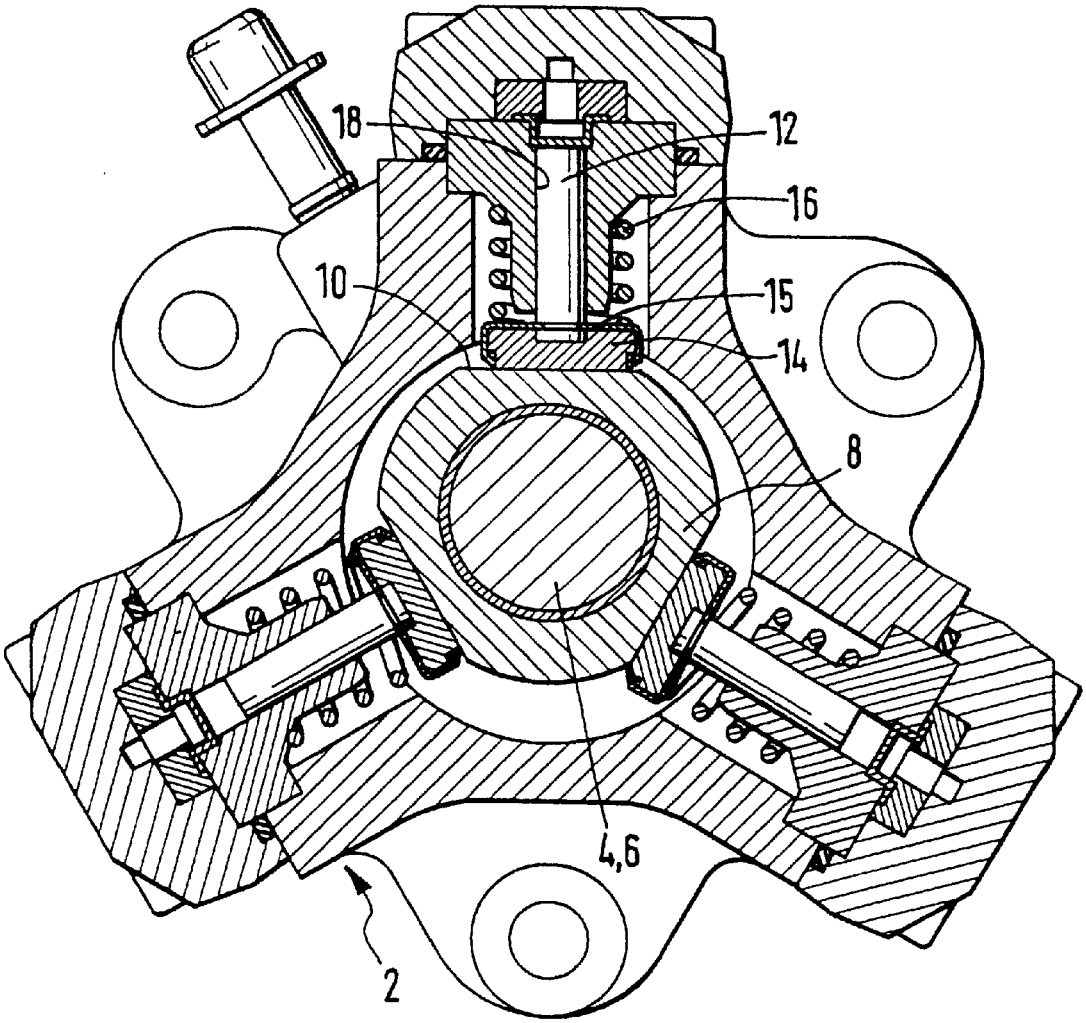
FIG. 1 shows a sectional view of a radial piston pump.

FIG. 1 shows a radial piston pump for supplying high fuel pressure in fuel injection systems of internal combustion engines. The radial piston pump is equipped with an integrated demand quantity regulation. The fuel supply and dimensioning is carried out by means of a metering unit that is not shown.

The radial piston pump according to the invention is particularly used in common rail injection systems to supply fuel to diesel engines. In this connection, "common rail" means the same thing as "common line". In contrast to conventional high-pressure injection systems in which the fuel is supplied to the individual combustion chambers by way of separate lines, the fuel injectors in common rail injection systems are supplied from a common line.

The radial piston pump shown in FIG. 1 includes a drive shaft 4, which is supported in a pump housing 2 and has an eccentrically embodied shaft section 6. On the eccentric shaft section 6, a polygonal ring 8 is provided, in relation to which the shaft section 6 can rotate. The ring 8 has three flattenings 10 offset from one another by 120°, against each of which a piston 12 is supported. In lieu of the polygonal ring 8, a cylindrical ring can also be used. The pistons 12 are each contained in a cylinder chamber 18 so that the piston can reciprocate in the radial direction in relation to the drive shaft 4.

A plate 14 is fastened to the end of each piston 12 oriented toward the drive shaft 4. The plates 14 are each secured to their affiliated piston by means of a cage 15. In addition, the plates 14 are each prestressed toward the ring 8 by means of a spring 16. As shown in FIG. 1, the plates 14 are disposed in contact with the flattenings 10 of the ring 8.

Figure 2:
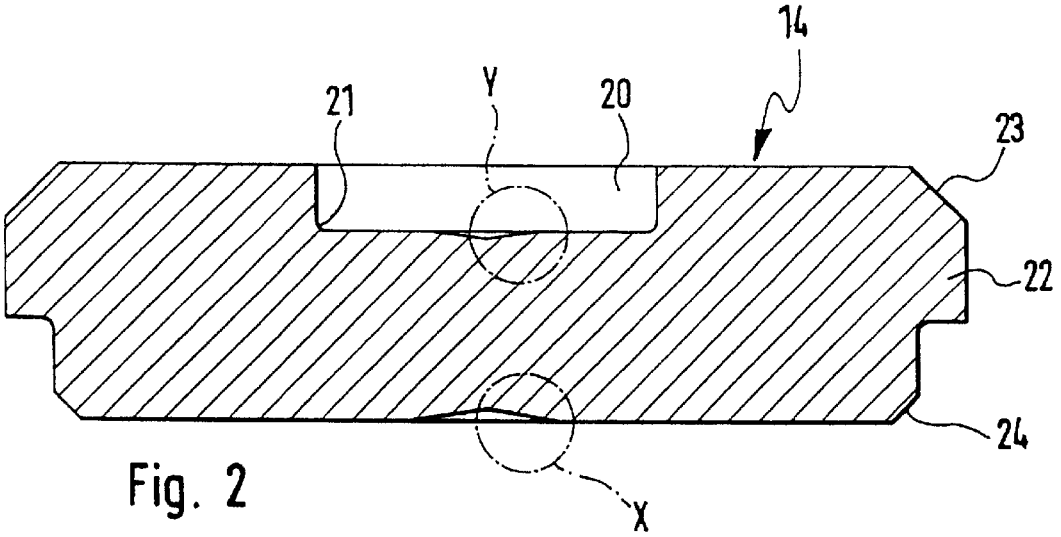
FIG. 2 shows a plate according to the current invention.

FIG. 2 shows only the plate 14 according to the invention. The plate, which is shown in cross section FIG. 2, has the form of a circular cylinder with a diameter of approximately 15 millimeters and a height of approximately 5 millimeters. A likewise circular, cylindrical recess 20 with a rounded edge 21 is cut out of the top of the plate 14, in the center. The recess 20 serves to receive one end of one of the pistons 12. The plate 14 is also provided with a collar 22, whose upper edge 23 is beveled and transitions into the top side of the plate 14. A bevel 24 is provided on the underside of the plate 14.

Figure 3:
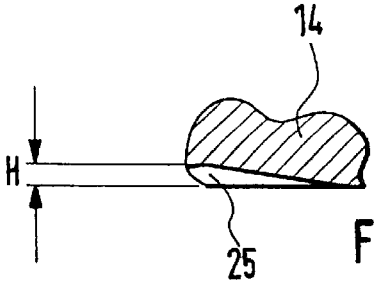
FIG. 3 shows an enlarged view of a detail X from FIG. 2, at a scale of 20:1.

FIG. 3 shows the detail X from FIG. 2 at a scale of 20:1. In the enlarged view, it is clear that the plate 14 has a conical recess 25 in the center of the underside opposite from the recess 20. The height H of the conical recess 25 is approximately 0.2 millimeters. The diameter of the conical recess 25 is approximately 2.8 millimeters.

Figure 4:
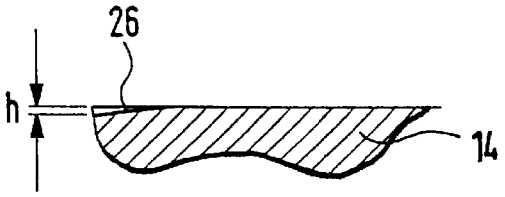
FIG. 4 shows an enlarged view of a detail Y from FIG. 2, at a scale of 20:1.

FIG. 4 shows the detail Y from FIG. 2 at a scale of 20:1. In the enlarged view, it is clear that the plate 14 has a conical recess 26 in the center of the recess 20. The height h of the conical recess 26 is approximately 0.02 millimeters.

The foregoing relates to a preferred exemplary of embodiments of the invention, it being understood that other variants and embodiments thereof are possible within the sprite and scope of the invention, the latter being defined by the appended claims.

I claim:

1. A radial piston pump for supplying high fuel pressure in fuel injection systems of internal combustion engines including a common rail, which comprises a pump housing (2), a drive shaft (4) supported in the pump housing (2), the shaft is embodied eccentrically or has cam-like projections in a circumference direction, a number of pistons, each in its own cylinder chamber (18), arranged radially with regard to the drive shaft (4), plates (14) respectively attached to an end of each of the pistons oriented toward the drive shaft (4), wherein the pistons (12) reciprocate in a radial direction in their respective cylinder chambers (18) by means of a rotation of the drive shaft (4), in the center, on a side oriented away from the drive shaft (4), each of the plates (14) have a recess in a center thereof in a form of a cone (26), whose tip is directed toward an inside of the plates (14) in order to reduce the stresses that occur in the center of the plates during operation.

2. The radial piston pump according to claim 1, in which in the center, on the side oriented toward the drive shaft (4), each of the plates (14) have a recess in the form of a cone (25), whose tip is directed toward the inside of the plate (14).

3. The radial piston pump according to claim 2, in which each of the plates (14) are circular in shape.

4. The radial piston pump according to claim 2, in which each of the plates (14) have a circular in shape recess (20) in their center.

5. The radial piston pump according to claim 2, in which each of the plates (14) have a collar (22).

6. The radial piston pump according to claim 2, in which a ring (8) is disposed between the drive shaft (4) and each of the plates (14).

7. The radial piston pump according to claim 1, in which in the center, on a side oriented away from the drive shaft (4) and on a side oriented toward the drive shaft (4), each of the plates (14) have first and second recesses, each in the form of a cone (25, 26), wherein the tips of the first and second cones (25, 26) are directed toward each other.

8. The radial piston pump according to claim 7, in which each of the plates (14) are circular in shape.

9. The radial piston pump according to claim 7, in which each of the plates (14) have a circular in shape recess (20) in their center.

10. The radial piston pump according to claim 7, in which each of the plates (14) have a collar (22).

11. The radial piston pump according to claim 7, in which a ring (8) is disposed between the drive shaft (4) and each of the plates (14).

12. The radial piston pump according to claim 1, in which a height of the second cone (26) on the side oriented away from the drive shaft (4) is approximately 1/10 the height of the first cone (25) on the side oriented toward the drive shaft (4).

13. The radial piston pump according to claim 12, in which each of the plates (14) are round.

14. The radial piston pump according to claim 12, in which each of the plates (14) have a circular in shape recess (20) in their center.

15. The radial piston pump according to claim 12, in which each of the plates (14) have a collar (22).

16.The radial piston pump according to claim 1, in which each of the plates (14) are circular in shape.

17. The radial piston pump according to claim 1, in which each of the plates (14) have a circular in shape recess (20) in their center.

18. The radial piston pump according to claim 1, in which each of the plates (14) have a collar (22).

19. The radial piston pump according to claim 1, in which a ring (8) is disposed between the drive shaft (4) and each of the plates (14).

* * * * *